US010159867B2

(12) United States Patent
Hao

(10) Patent No.: US 10,159,867 B2
(45) Date of Patent: Dec. 25, 2018

(54) EXERCISER

(71) Applicant: Dyaco International Inc., Taipei (TW)

(72) Inventor: Kuo-Wo Hao, Taipei (TW)

(73) Assignee: Dyaco International Inc., Taipei (TW)

( * ) Notice: Subject to any disclaimer, the term of this patent is extended or adjusted under 35 U.S.C. 154(b) by 85 days.

(21) Appl. No.: 15/400,148

(22) Filed: Jan. 6, 2017

(65) Prior Publication Data

US 2018/0169458 A1 Jun. 21, 2018

(30) Foreign Application Priority Data

Dec. 21, 2016 (TW) ..... 105142363 A

(51) Int. Cl.

| | |
|---|---|
| ***A63B 23/16*** | (2006.01) |
| ***A63B 21/02*** | (2006.01) |
| ***A63B 23/035*** | (2006.01) |
| *A63B 21/00* | (2006.01) |
| *A63B 21/04* | (2006.01) |

(52) U.S. Cl.

CPC ..... *A63B 21/028* (2013.01); *A63B 21/00065* (2013.01); *A63B 21/4035* (2015.10); *A63B 23/03508* (2013.01); *A63B 23/16* (2013.01); *A63B 21/00061* (2013.01); *A63B 21/00069* (2013.01); *A63B 21/0421* (2013.01); *A63B 21/151* (2013.01); *A63B 21/4047* (2015.10)

(58) Field of Classification Search

CPC ..... A63B 23/16

See application file for complete search history.

(56) References Cited

U.S. PATENT DOCUMENTS

| | | | | |
|---|---|---|---|---|
| 3,622,152 | A * | 11/1971 | Place | A63B 22/20 482/132 |
| 5,360,385 | A | 11/1994 | Wang | |
| 5,720,701 | A * | 2/1998 | Truini | A63B 21/0004 482/122 |
| 6,786,849 | B1 | 9/2004 | Faulconer | |
| 2016/0235613 | A1 * | 8/2016 | Waldman | A63B 23/16 |

FOREIGN PATENT DOCUMENTS

| | | | |
|---|---|---|---|
| CN | 1226062 | C | 11/2005 |
| CN | 102908756 | A | 2/2013 |
| CN | 104853815 | A | 8/2015 |
| TW | M492177 | U | 12/2014 |

OTHER PUBLICATIONS

Office Action dated Feb. 15, 2017 in corresponding Taiwan Patent Application No. 105142363.

* cited by examiner

*Primary Examiner* — Loan H Thanh
*Assistant Examiner* — Rae Fischer
(74) *Attorney, Agent, or Firm* — Donald E. Stout; Stout, Uxa & Buyan, LLP

(57) ABSTRACT

An exerciser is provided with a first operating arm and a second operating arm pivotally connects with an axis. Each of the first operating arm and the second operating arm includes a first end and a second end and the second end is used to be held by an operator. In addition, one or more non-metal elastic members are selected to couple with the first end or the second end of the first operating arm and the second operating arm, thus to provide resistance for the rotation of the first operating arm and the second operating arm.

7 Claims, 12 Drawing Sheets

13'

EXERCISER

CROSS-REFERENCE TO RELATED APPLICATIONS

The entire contents of Taiwan Patent Application No. 105142363, filed on Dec. 21, 2016, from which this application claims priority, are expressly incorporated herein by reference.

BACKGROUND OF THE INVENTION

1. Field of the Invention

The present invention relates to an exerciser, and more particularly relates to an exerciser operated with one or more non-metal elastomers.

2. Description of Related Art

Grippers or hand grippers are primarily used for increasing the strength of the hands. A conventional gripper is shown by a Taiwan Patent M501872.

There are differences from brand to brand, but the common features of standard grippers are that they use a torsion spring fitted with two handles. The springs are made from various types of steel, and the handles are generally made from plastic or metal.

Conventional grippers have disadvantages that the mechanism of grippers is complex, the operation is not smooth and the operation safety needs to be improved.

SUMMARY OF THE INVENTION

In one general aspect, the present invention relates to an exerciser that has simple mechanism and is easy to assemble and maintain and convenient to adjust a resistance of the exerciser.

According to an embodiment of the present invention, an exerciser is provided with a first operating arm, a second operating arm, and one or more non-metal elastomers. Both the first operating arm and the second operating arm have a first end and a second end. The first operating arm and the second operating arm pivotally connect with an axis, and the second end of the first operating arm and the second end of the second operating arm are held by a user. The one or more non-metal elastomers are selected to couple with the first end or the second end of the first operating arm and the second operating arm, thereby to adjust a resistance for a rotation of the first operating arm and the second operating arm.

In an embodiment, the one or more non-metal elastomers comprises one or more ring elastomers, and each of the one or more ring elastomers can couple with the first end of the first operating arm and the first end of the second operating arm.

In an embodiment, both the first end of the first operating arm and the first end of the second operating arm include an arc-shaped configuration, and each of the ring elastomers can couple with a left side or a right side of the arc-shaped configuration.

In an embodiment, each of the ring elastomers comprises a first portion and a second portion, and a side of the first portion and a side of the second portion are at least partially connected so as to form a safety line.

In an embodiment, the one or more non-metal elastomers comprise one or more string elastomers, and each of the one or more string elastomers has a first end to couple with the first end of the first operating arm and a second end to couple with the first end of the second operating arm.

In an embodiment, both the first end of the first operating arm and the first end of the second operating arm comprise an arc-shaped configuration, the arc-shaped configuration comprises at least one limiting portion, and the first end and the second end of the string elastomer is arc-shaped to respectively fitting the arc-shaped configuration of the first operating arm and the second operating arm by the at least one limiting portion.

In an embodiment, both the first end of the first operating arm and the first end of the second operating arm comprise an arc-shaped configuration, an inside of the arc-shaped configuration comprises a rib, and the first end and the second end of the string elastomer comprises a hole to be passed through by the rib.

In an embodiment, the one or more non-metal elastomers have different coefficients of elasticity.

In an embodiment, the one or more non-metal elastomers are made of rubber.

In an embodiment, the one or more non-metal elastomers comprises a ball elastomer, and a left side and a right side of the ball elastomer respectively have a recess to couple with the second end of the first operating arm and the second end of the second operating arm, respectively.

In an embodiment, the ball elastomer is made of rubber or thermoplastic rubber.

DETAILED DESCRIPTION OF THE PREFERRED EMBODIMENT

Figure 1A:
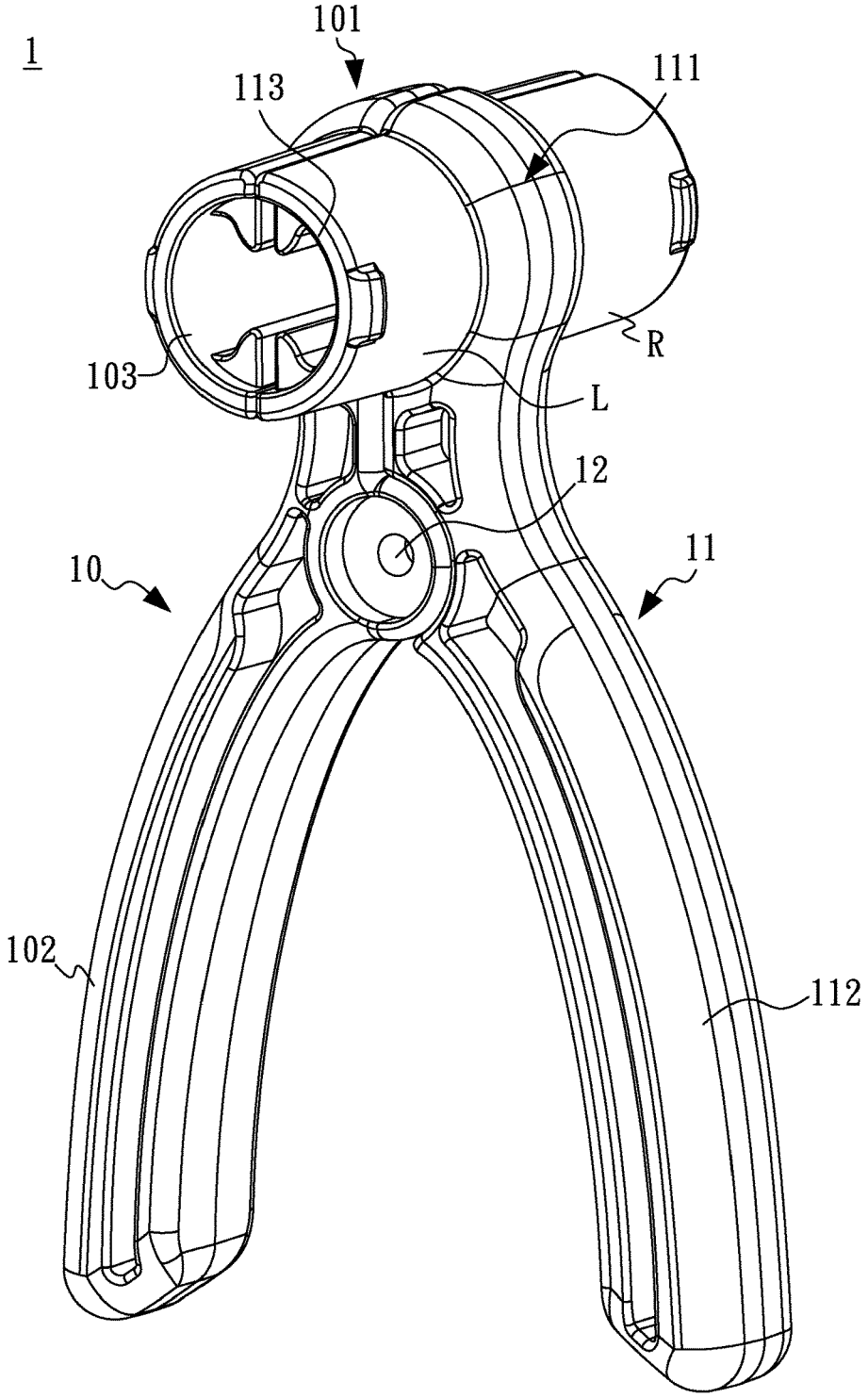
FIGS. 1A and 1B are perspective view and side view, respectively, showing an exerciser according to a preferred embodiment of the present invention.

Embodiments of the invention are now described and illustrated in the accompanying drawings, instances of which are to be interpreted to be to scale in some implementations while in other implementations, for each instance, not. In certain aspects, use of like or the same reference designators in the drawings and description refers to the same, similar or analogous components and/or elements, while according to other implementations the same use should not. According to certain implementations, use of directional terms, such as, top, bottom, left, right, up, down, over, above, below, beneath, rear, front, clockwise, and counterclockwise, are to be construed literally, while in other implementations the same use should not. While the invention will be described in conjunction with these specific embodiments, it will be understood that it is not intended to limit the invention to these embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well-known process operations and components are not described in detail in order not to unnecessarily obscure the present invention. While drawings are illustrated in detail, it is appreciated that the quantity of the disclosed components may be greater or less than that disclosed, except where expressly restricting the amount of the components.

Figure 1B:
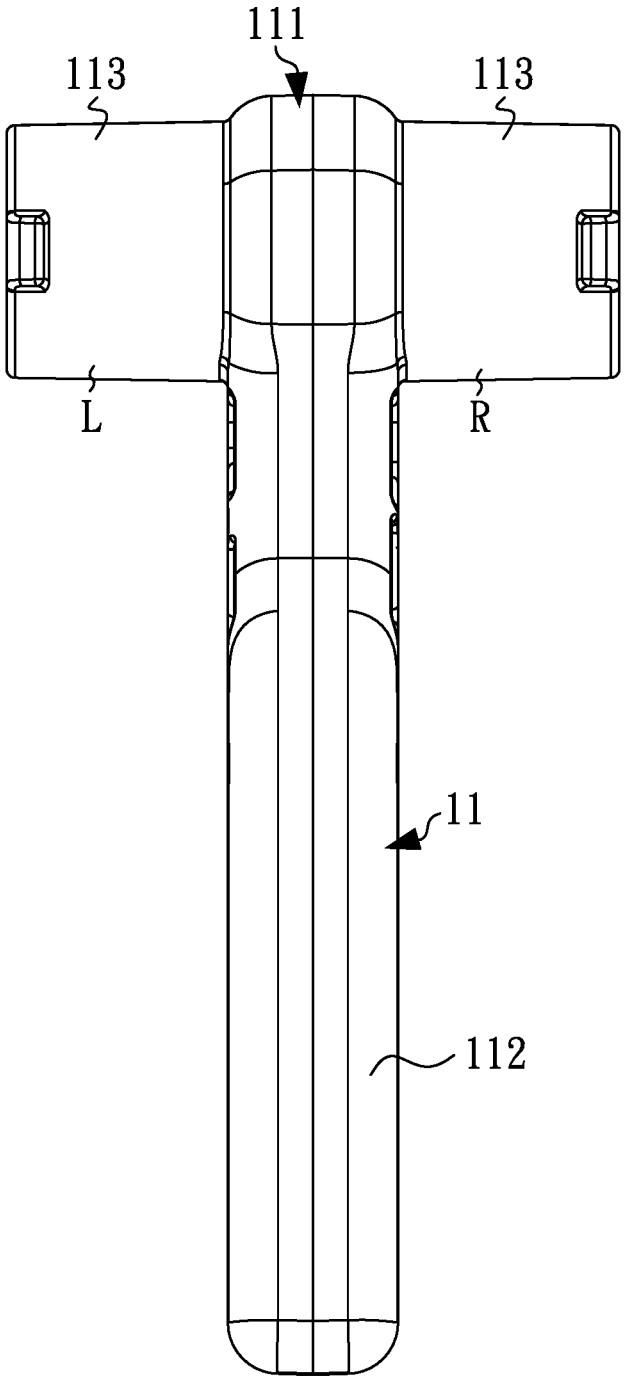

FIGS. 1A and 1B are perspective view and side view, respectively, showing an exerciser 1 according to a preferred embodiment of the present invention. The exerciser 1 mainly includes a first operating arm 10 and a second operating arm 11. The first operating arm 10 and the second operating arm 11 pivotally connect with an axis 12, so that the first operating arm 10 and the second operating arm 11 can rotate around the axis 12. In addition, the first operating arm 10 includes a first end 101 and a second end 102, and the second end 102 is used to be held by a user; the second operating arm 11 includes a first end 111 and a second end 112, and the second end 112 is used to be held by the user. Preferably, the first operating arm 10 and the second operating arm 11 are made of a non-metal material, such as plastics.

In addition, the exerciser 1 further includes one or more non-metal elastomers (which will be discussed later), and one or more of the non-metal elastomers can be selected to couple with the first end 101/111 or the second end 102/112 of the first operating arm 10 and the second operating arm 11, thereby to provide and adjust the resistance for the rotation of the first operating arm 10 and the second operating arm 11.

Figure 1C:
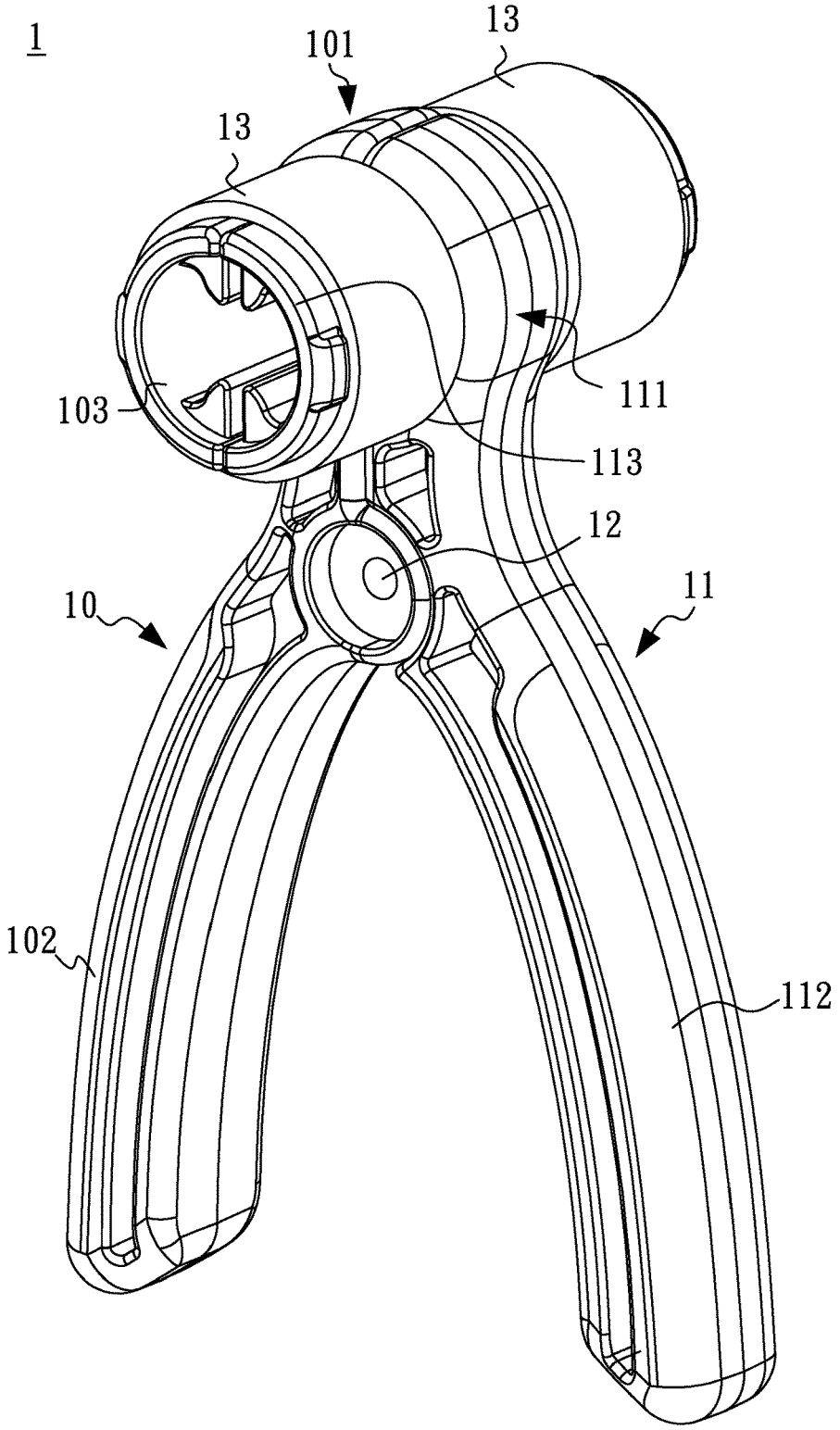
FIGS. 1C and 1D are perspective views showing the exerciser operated with ring elastomers according to the preferred embodiment of the present invention.
Figure 1D:
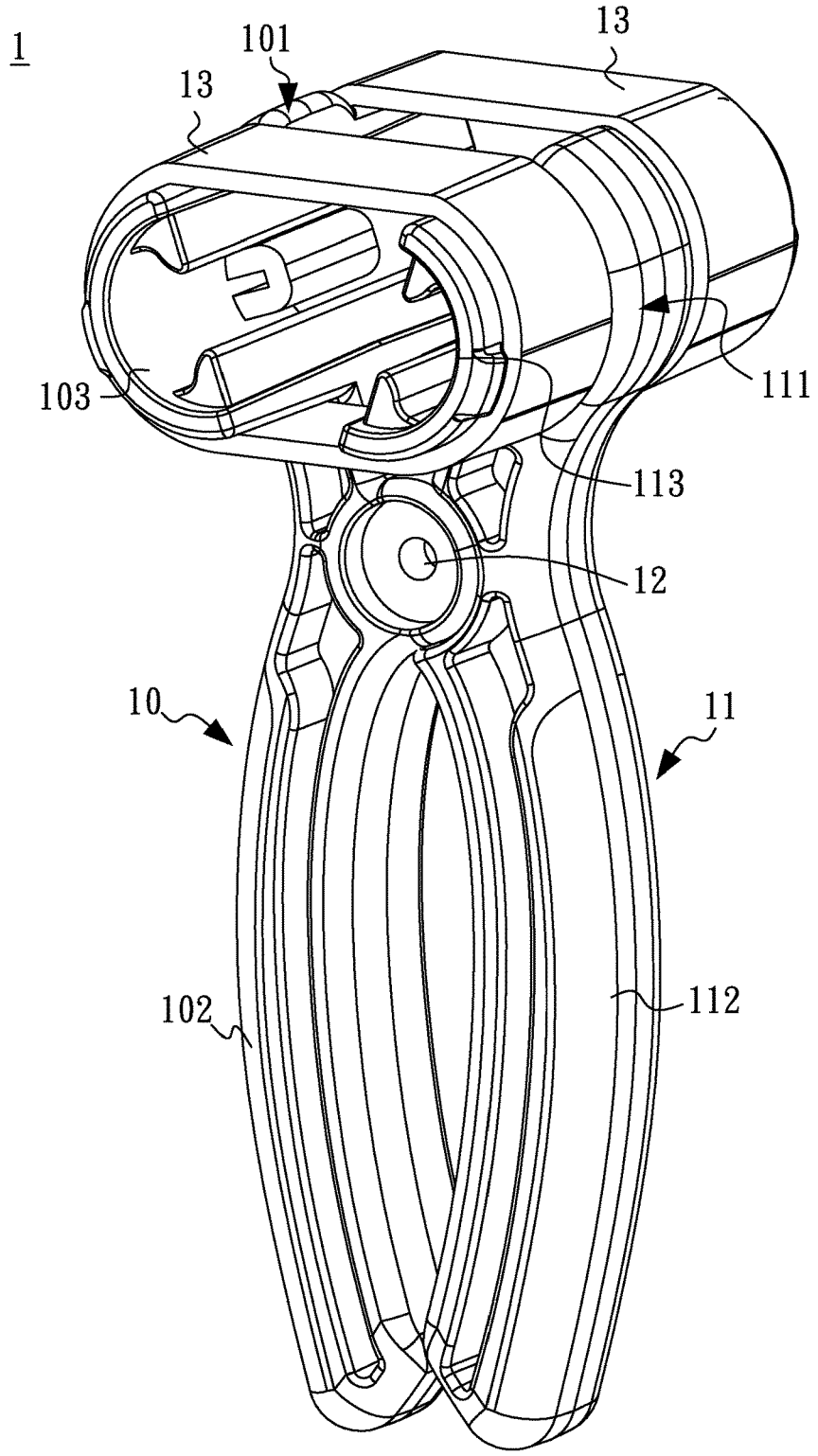

FIGS. 1C and 1D are perspective views showing the exerciser 1 operated with ring elastomers 13 according to the preferred embodiment of the present invention. Referring to FIGS. 1C and 1D, the one or more non-metal elastomers comprise one or more ring elastomers 13, and each of the ring elastomers 13 can couple with the first end 101 of the first operating arm 10 and the first end 111 of the second operating arm 11. The shape of the ring elastomers 13 can be round, ellipse, or others. The ring elastomers 13 may have different dimensions, thicknesses, or coefficients of elasticity. The user can select suitable one or more of the ring elastomers 13 to couple with the first end 101 of the first operating arm 10 and the first end 111 of the second operating arm 11, thereby to adjust a suitable resistance between the first operating arm 10 and the second operating arm 11. FIG. 1C shows that two of the ring elastomers 13 couple with the first end 101 of the first operating arm 10 and the first end 111 of the second operating arm 11 while the first operating arm 10 and the second operating arm 11 are not operated. FIG. 1D shows that the first operating arm 10 and the second operating arm 11 are being operated and the two coupled ring elastomers 13 provide a resistance.

Referring to FIGS. 1A and 1B, the first end 101 of the first operating arm 10 and the first end 111 of the second operating arm 11 may have a suitable configuration adapted to couple with the ring elastomers 13. For example, referring to FIGS. 1A and 1B, the first end 101 of the first operating arm 10 may have an arc-shaped configuration 103 adapted to couple with the ring elastomers 13, and the first end 111 of the second operating arm 11 may also have an arc-shaped configuration 113 adapted to couple with the ring elastomers 13. The arc-shaped configuration 103 may extend from the first end 101 to the two sides of the first end 101 of the first operating arm 10, and the arc-shaped configuration 113 may extend from the first end 111 to the two sides of the first end 111 of the second operating arm 11. Referring to FIGS. 1A and 1B and taking the arc-shaped configuration 113 as an example, the arc-shaped configuration 113 is perpendicular to the second operating arm 11 and extends to the two sides of the first end 111 of the second operating arm 11, such that a T-shaped configuration is constituted by the arc-shaped configuration 113 and the second operating arm 11. A left side L and a right side R of arc-shaped configuration 113 are respectively arranged at a left side and a right ride of the second operating arm 11. The left side L and the right side R may have concave surface adapted to couple with the ring elastomers 13. In this embodiment, each of the arc-shaped configurations 103/113 is semicircle-shaped, and the combination of the two arc-shaped configurations 103/113 gets a complete circle. In other embodiments of the present invention, each of the arc-shaped configurations 103/113 can be semi-ellipse shaped or other suitable configurations, such as polygon.

Figure 5:
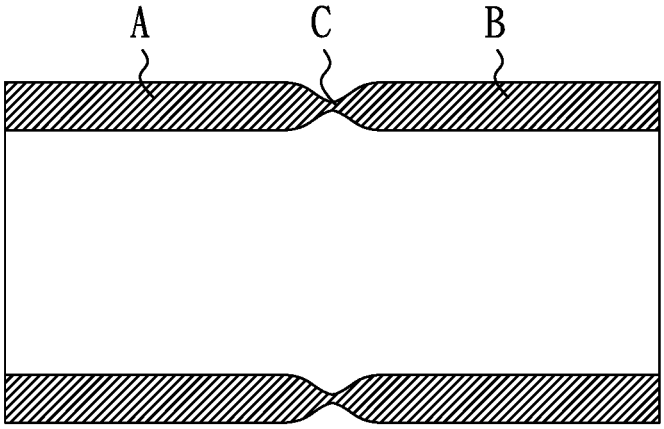
FIG. 5 is a cross-sectional view showing a ring elastomer according to another embodiment of the present invention.

Referring to FIGS. 1B and 1C, the left side L and the right side R of the arc-shaped configuration 113 are coupled with a ring elastomer 13, respectively. FIG. 5 is a cross-sectional view showing a ring elastomer 13' according to another embodiment of the present invention. The ring elastomer 13' may have a portion A and a portion B, wherein a side of the portion A and a side of the portion B are at least partially connected to form a safety line C. This design has advantage that if one of the portion A and portion B is cracked, the crack is stopped at the safety line C and the ring elastomer 13' will not burst into two pieces so that the operation safety can be assured.

Figure 2A:
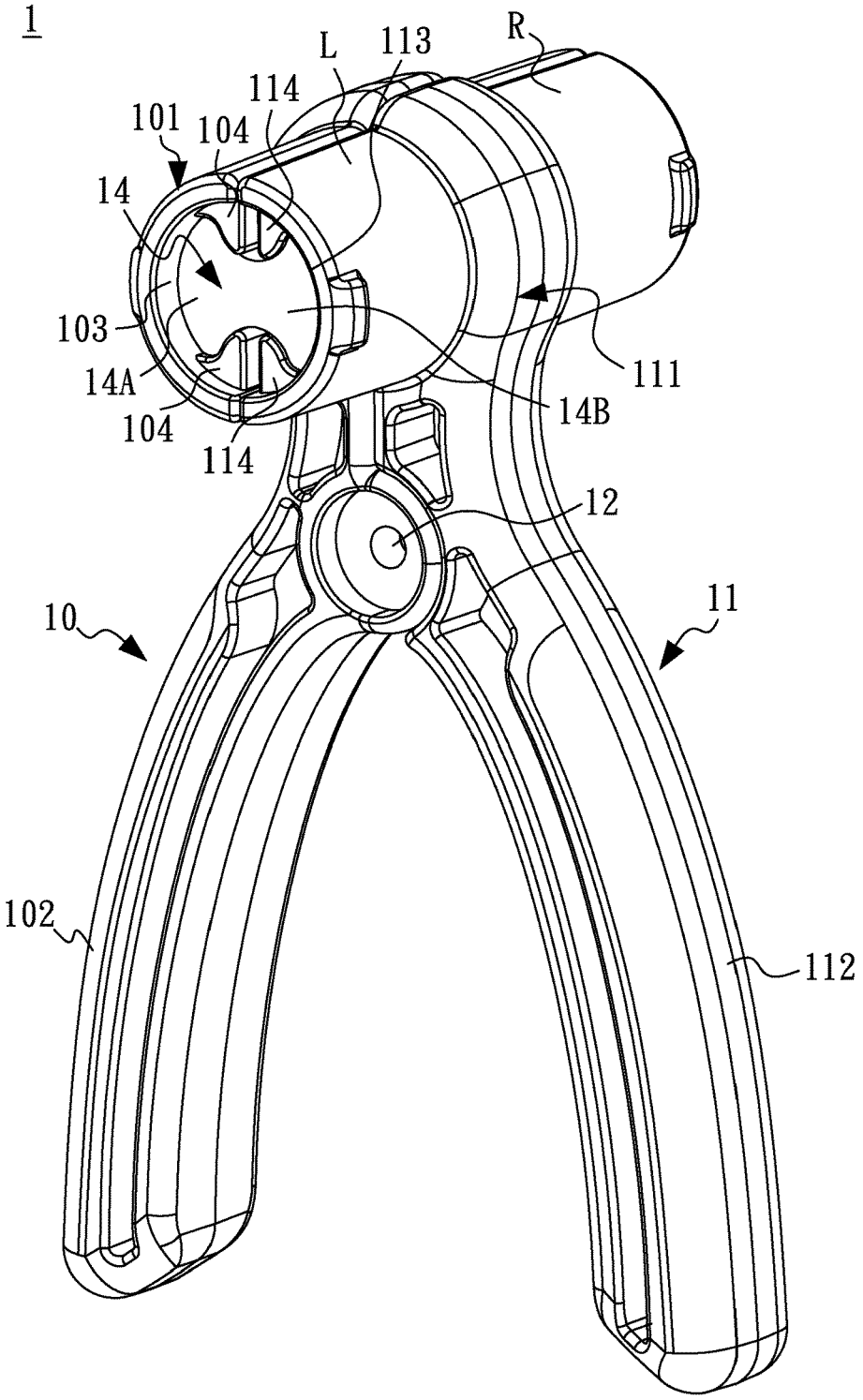
FIGS. 2A and 2B are perspective views showing the exerciser operated with string elastomers according to the preferred embodiment of the present invention.
Figure 2B:
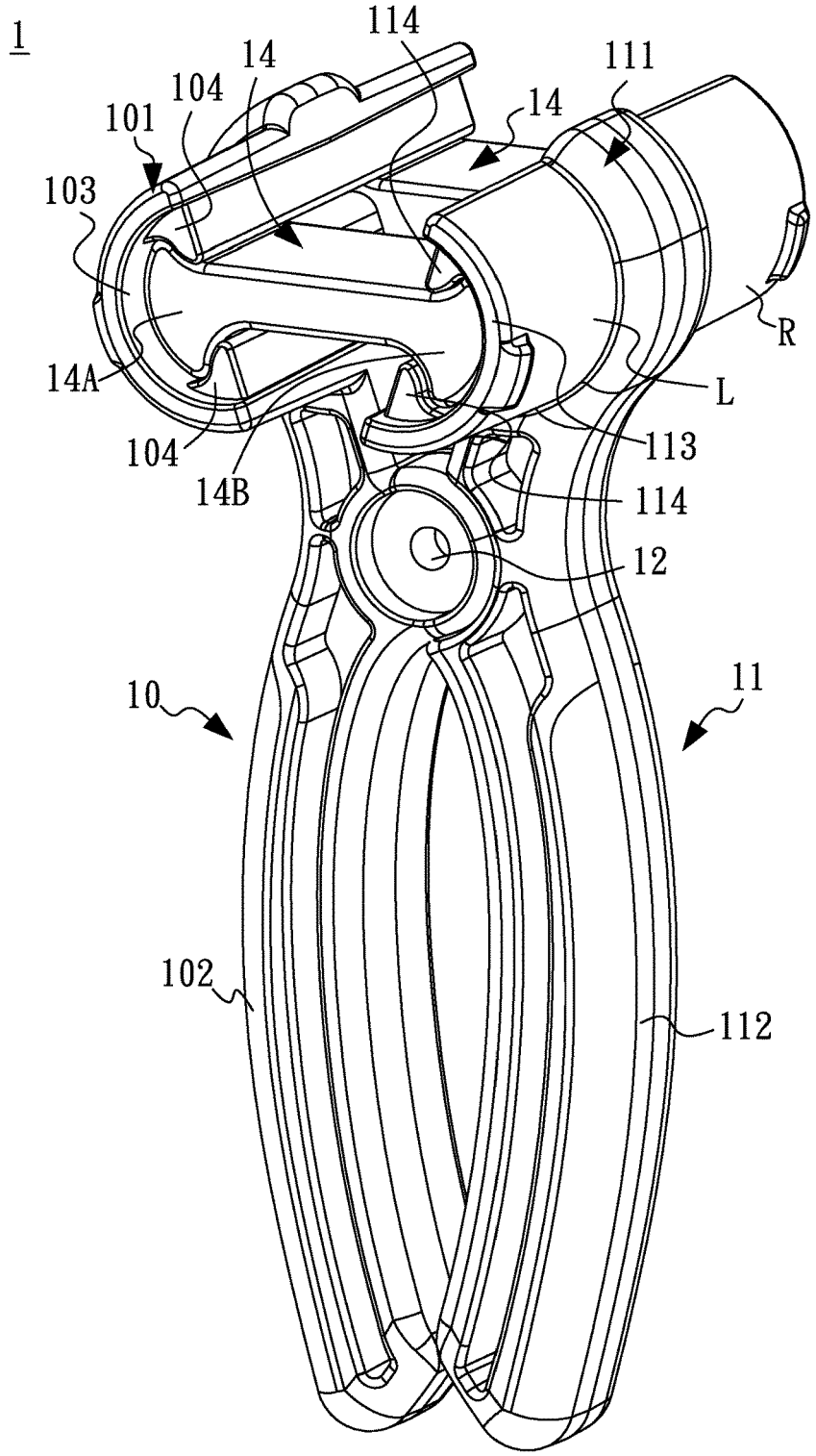

FIGS. 2A and 2B are perspective views showing the exerciser 1 operated with string elastomers 14 according to the preferred embodiment of the present invention. Referring to FIGS. 2A and 2B, the one or more non-metal elastomers comprise one or more string elastomers 14, and each of the string elastomers 14 has a first end 14A to couple with the first end 101 of the first operating arm 10 a second end 14B to couple with the first end 111 of the second operating arm 11.

Referring to FIGS. 2A and 2B, the first end 101 of the first operating arm 10 may have an arc-shaped configuration 103 adapted to couple with the string elastomers 14, and the first end 111 of the second operating arm 11 may have an arc-shaped configuration 113 adapted to couple with the string elastomers 14. In addition, the arc-shaped configuration 103 may have two limiting portions 104, the arc-shaped configuration 113 may have two limiting portions 114, and the first end 14A and the second end 14B of the string elastomer 14 may have arc-shaped configuration to fit the arc-shaped configuration 103 and the arc-shaped configuration 113, respectively. Therefore, the string elastomer 14 can couple with the inside of the left side L or the right side R of the arc-shaped configuration 103 and the arc-shaped configuration 113 by fitting. FIG. 2A shows that two of the string elastomers 14 couple with the inside of the arc-shaped configuration 103 and the arc-shaped configuration 113 by fitting while the first operating arm 10 and the second operating arm 11 are not operated. FIG. 2B shows that the first operating arm 10 and the second operating arm 11 are being operated and the two string elastomers 14 provide a resistance.

In another embodiment of the present invention, the inside of each of the arc-shaped configuration 103/113 has a rib (not shown), and the first end 14A and the second end 14B of the string elastomer 14 has a hole (not shown) through which the rib passes.

In the preferred embodiment of the present invention, the ring elastomers 13 and the string elastomers 14 are made of rubber. In another embodiment of the present invention, the ring elastomers 13 and the string elastomers 14 are made of foam or polymer.

Figure 3A:
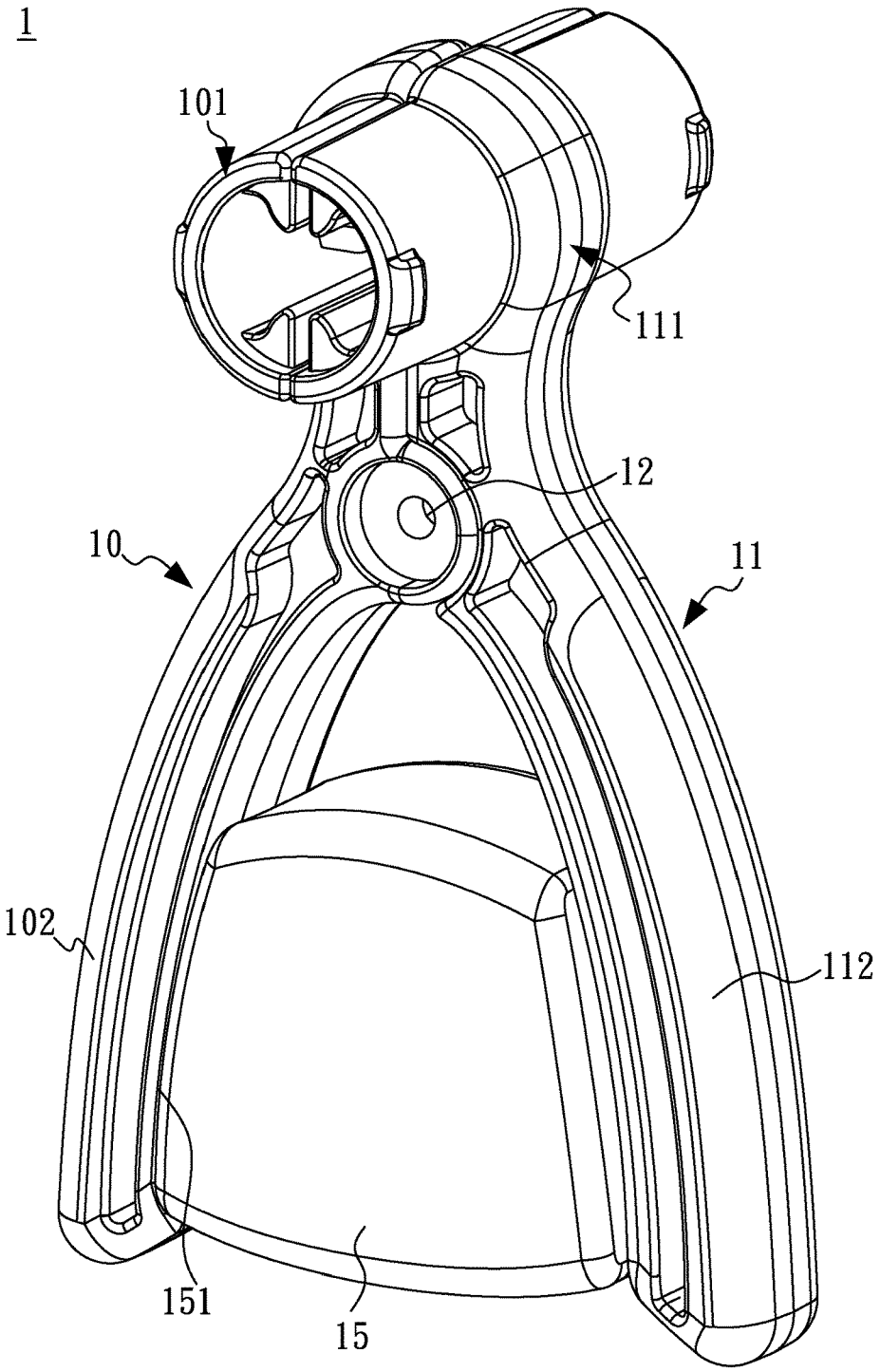
FIGS. 3A, 3B, and 3C are perspective views showing the exerciser operated with a ball elastomer according to the preferred embodiment of the present invention.
Figure 3B:
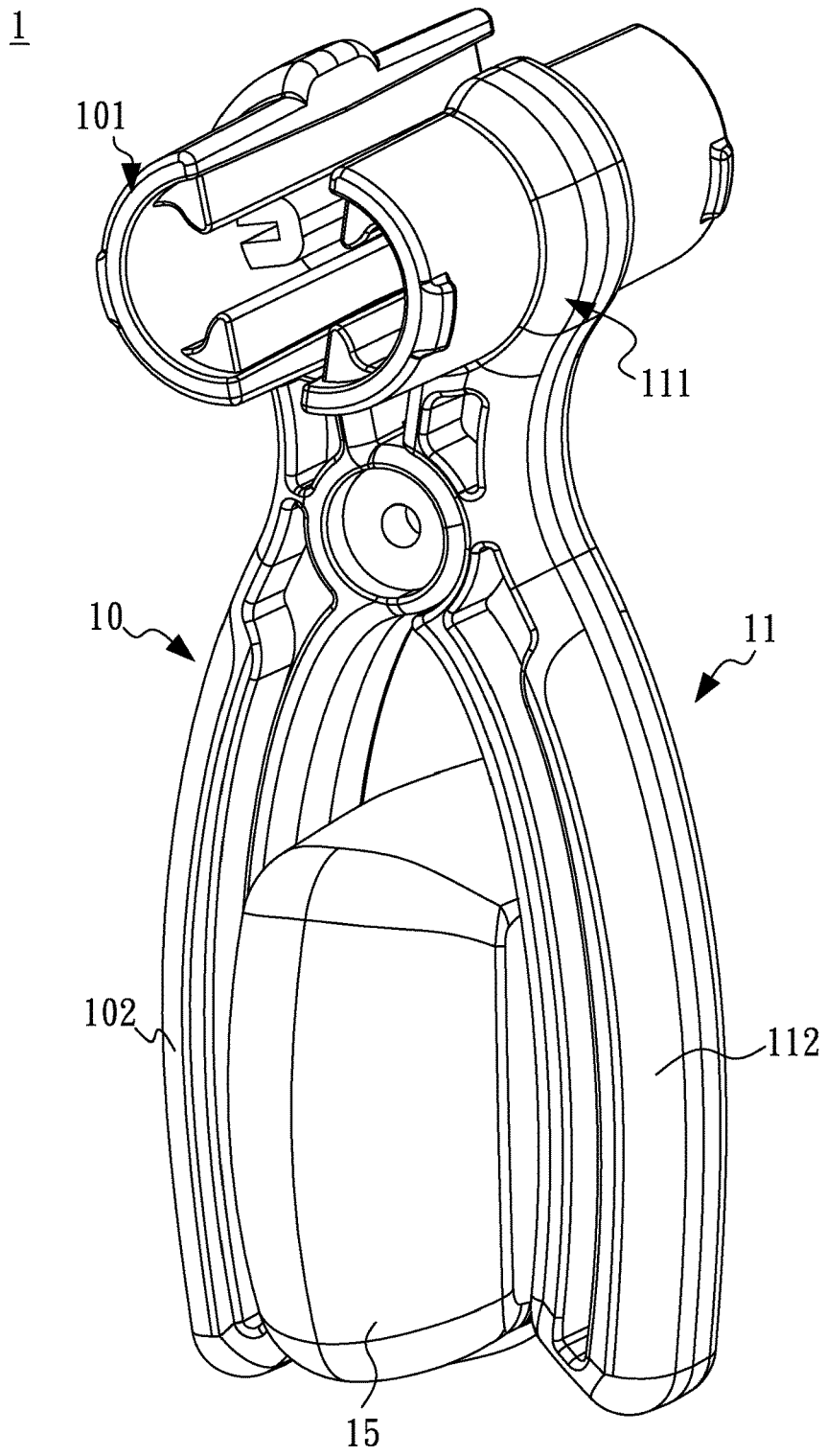
Figure 3C:
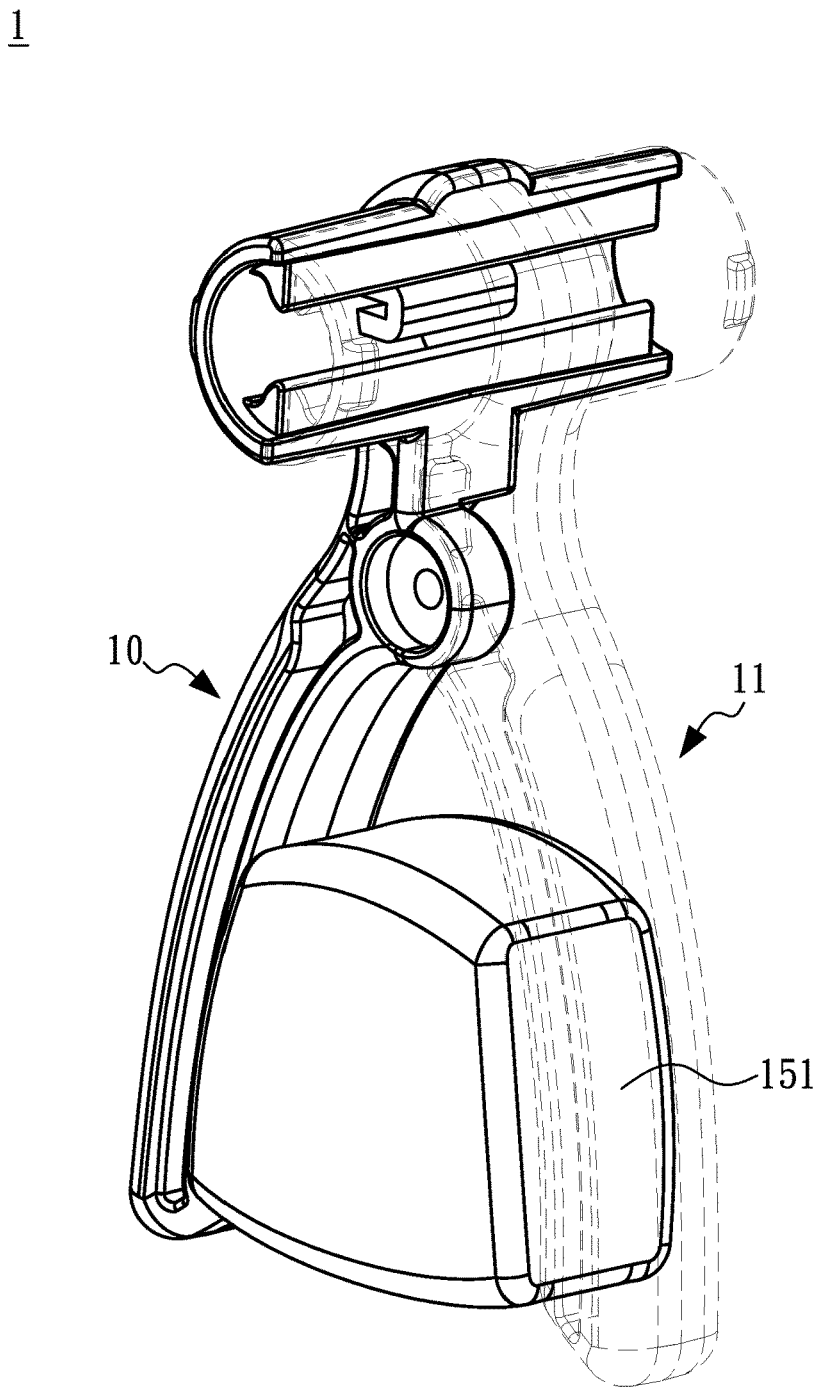

FIGS. 3A, 3B, and 3C are perspective views showing the exerciser 1 operated with a ball elastomer 15 according to the preferred embodiment of the present invention. Referring to FIGS. 3A, 3B, and 3C, the one or more non-metal elastomers comprise a ball elastomer 15, and a left side and a right side of the ball elastomer 15 may have a recess, respectively, to fitting with the second end 102 of the first operating arm 10 and the second end 112 of the second operating arm 11. FIG. 3A shows that the ball elastomer 15 couples the first operating arm 10 and the second operating arm 11 while the first operating arm 10 and the second operating arm 11 are not operated. FIG. 3B shows that the first operating arm 10 and the second operating arm 11 are being operated and the ball elastomer 15 provide a resistance.

In the preferred embodiment of the present invention, the ball elastomer 15 is made of rubber or thermoplastic rubber (TPR). In another embodiment of the present invention, the ball elastomer 15 is made of foam or polymer.

Figure 4A:
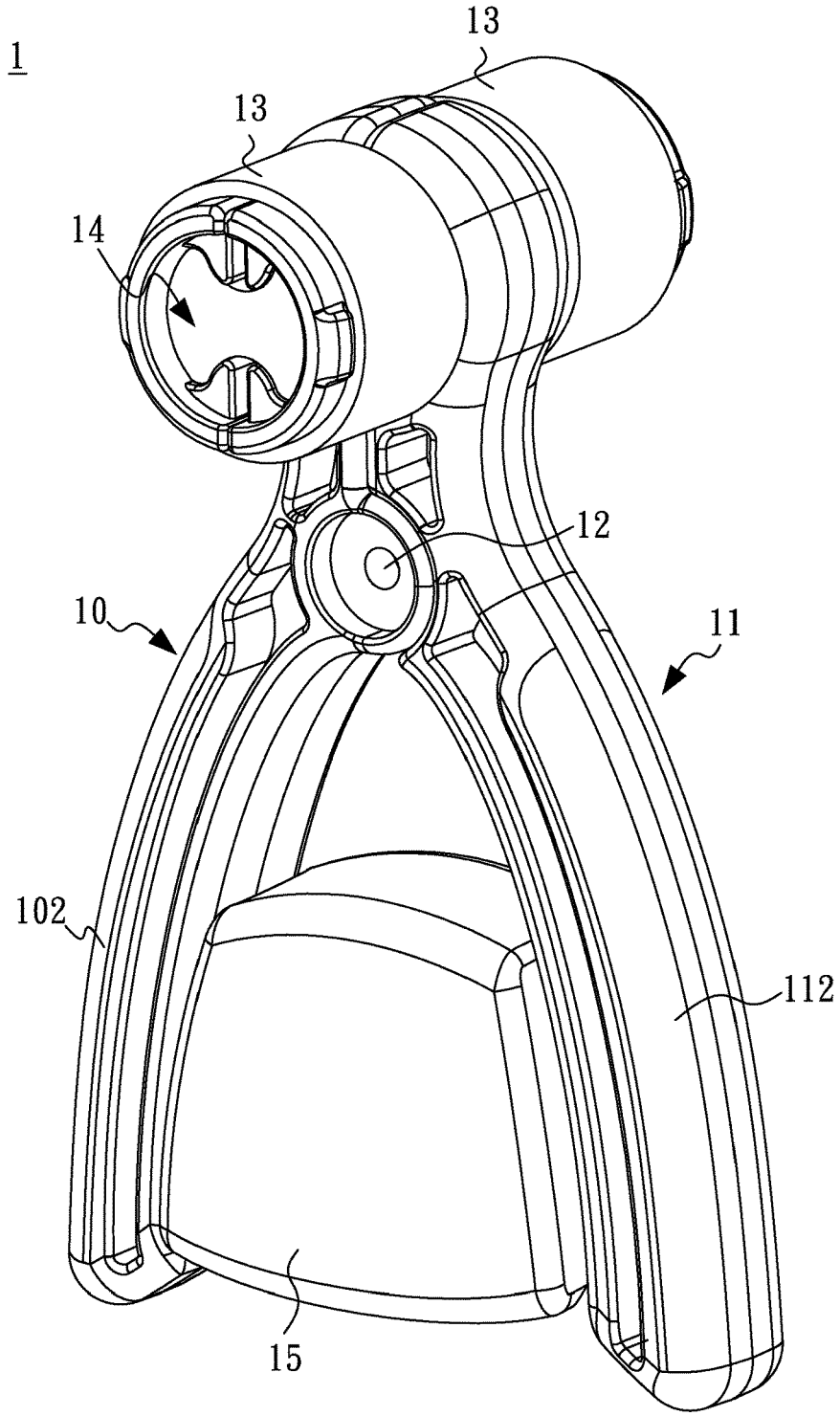
FIGS. 4A and 4B are perspective views showing the exerciser with ring elastomers, the string elastomers, and the ball elastomer according to the preferred embodiment of the present invention.
Figure 4B:
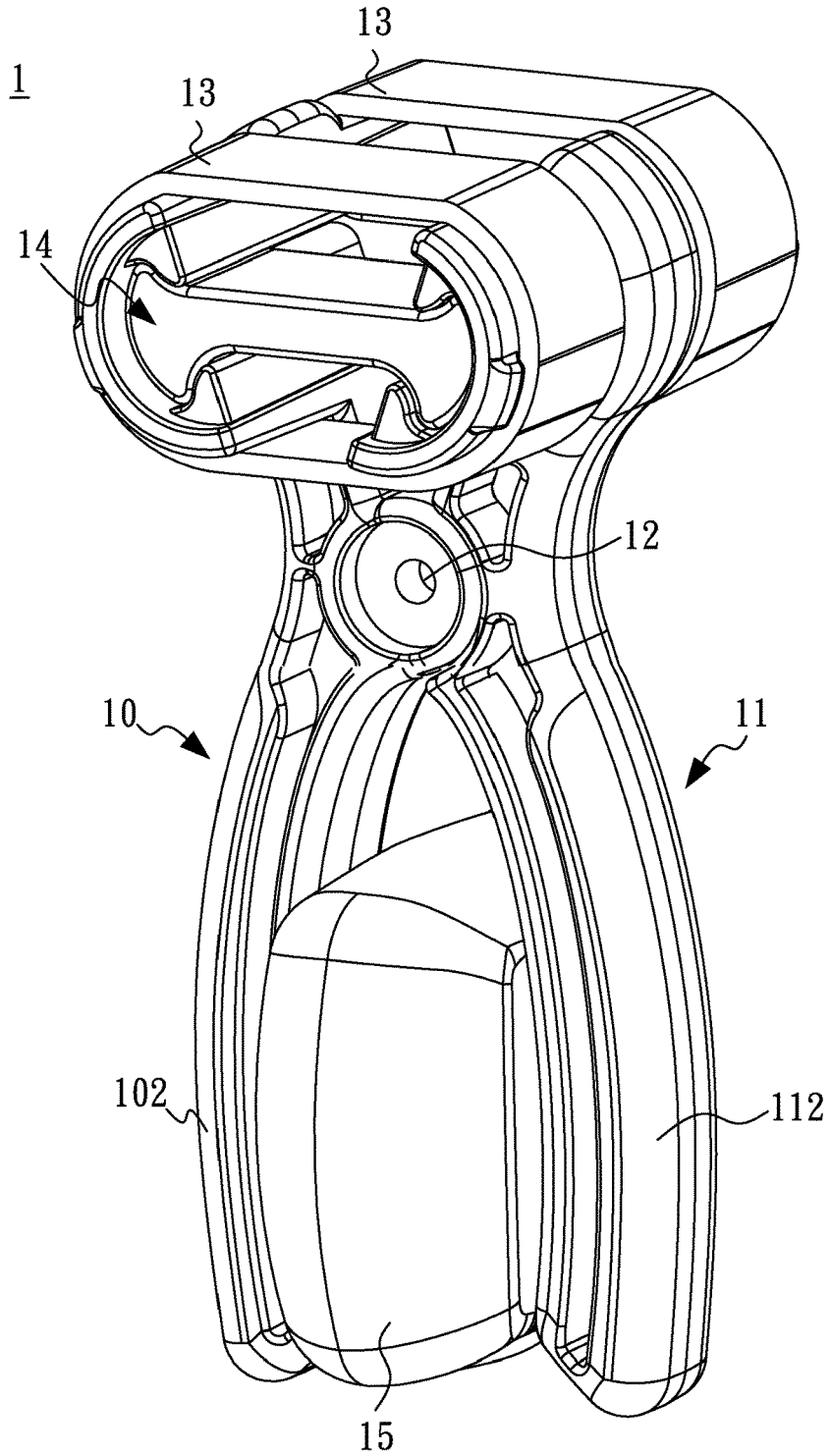

Accordingly, the user can select one or more of the non-metal elastomers, such as one or more of the ring elastomers 13, string elastomers 14, and ball elastomer 15, so as to adjust the resistance of the exerciser 1. FIGS. 4A and 4B are perspective views show that the exerciser 1 is operated with ring elastomers 13, the string elastomers 14, and the ball elastomer 15 according to the preferred embodiment of the present invention. FIG. 4A shows that the ring elastomers 13, the string elastomers 14, and the ball elastomer 15 couple with the first operating arm 10 and the second operating arm 11 while the first operating arm 10 and the second operating arm 11 are not operated. FIG. 4B shows that the first operating arm 10 and the second operating arm 11 are being operated and the ring elastomers 13, the string elastomers 14, and the ball elastomer 15 provide a resistance. In another embodiment of the present invention, the exerciser 1 is operated with the ring elastomers 13 and the ball elastomer 15. In another embodiment of the present invention, the exerciser 1 is operated with the string elastomer 14 and the ball elastomer 15. In another embodiment of the present invention, the exerciser 1 is operated with the ring elastomers 13 and the string elastomers 14.

Accordingly, embodiments of the present invention provide an exerciser 1 that has simple mechanism and is easy to assemble. In addition, the exerciser 1 can be completely made of non-metal material, in which the axis 12 can be made of metal if necessary. Therefore, the operation safety of the exerciser 1 can be assured. The user can select one or more of the non-metal elastomers, such as one or more of the ring elastomers 13, string elastomers 14, and ball elastomer 15 in any combination, to couple them with the first operating arm 10 and the second operating arm 11 by hands without using any tool. Therefore, the desired resistance of the exerciser 1 can be conveniently adjusted, and thus the training effect can be promoted. Instead of springs of conventional grippers, the exerciser 1 of this invention employs one or more non-metal elastomers that can provide versatile resistances for chosen by the user, and each non-metal elastomer or a combination of the elastomers provides a wide linear relationship between the force exerted to the elastomer and strain of the elastomer, so that the operation of the exerciser 1 is quite smooth, sensible, and solid, and a good training effect can be expected.

The intent accompanying this disclosure is to have each/all embodiments construed in conjunction with the knowledge of one skilled in the art to cover all modifications, variations, combinations, permutations, omissions, substitutions, alternatives, and equivalents of the embodiments, to the extent not mutually exclusive, as may fall within the spirit and scope of the invention. Corresponding or related structure and methods disclosed or referenced herein, and/or in any and all co-pending, abandoned or patented application(s) by any of the named inventor(s) or assignee(s) of this application and invention, are incorporated herein by reference in their entireties, wherein such incorporation includes corresponding or related structure (and modifications thereof) which may be, in whole or in part, (i) operable and/or constructed with, (ii) modified by one skilled in the art to be operable and/or constructed with, and/or (iii) implemented/made/used with or in combination with, any part(s) of the present invention according to this disclosure, that of the application and references cited therein, and the knowledge and judgment of one skilled in the art.

Conditional language, such as, among others, "can," "could," "might," or "may," unless specifically stated otherwise, or otherwise understood within the context as used, is generally intended to convey that embodiments include, and in other interpretations do not include, certain features, elements and/or steps. Thus, such conditional language is not generally intended to imply that features, elements and/or steps are in any way required for one or more embodiments, or interpretations thereof, or that one or more embodiments necessarily include logic for deciding, with or without user input or prompting, whether these features, elements and/or steps are included or are to be performed in any particular embodiment.

All of the contents of the preceding documents are incorporated herein by reference in their entireties. Although the disclosure herein refers to certain illustrated embodiments, it is to be understood that these embodiments have been presented by way of example rather than limitation. For example, any of the particulars or features set out or referenced herein, or other features, including method steps and techniques, may be used with any other structure(s) and process described or referenced herein, in whole or in part, in any combination or permutation as a non-equivalent, separate, non-interchangeable aspect of this invention. Corresponding or related structure and methods specifically contemplated and disclosed herein as part of this invention, to the extent not mutually inconsistent as will be apparent from the context, this specification, and the knowledge of one skilled in the art, including, modifications thereto, which may be, in whole or in part, (i) operable and/or constructed with, (ii) modified by one skilled in the art to be operable and/or constructed with, and/or (iii) implemented/made/used with or in combination with, any parts of the present invention according to this disclosure, include: (I) any one or more parts of the above disclosed or referenced structure and methods and/or (II) subject matter of any one or more of the inventive concepts set forth herein and parts thereof, in any permutation and/or combination, include the subject matter of any one or more of the mentioned features and aspects, in any permutation and/or combination.

Although specific embodiments have been illustrated and described, it will be appreciated by those skilled in the art that various modifications may be made without departing from the scope of the present invention, which is intended to be limited solely by the appended claims.

What is claimed is:

1. An exerciser, comprising:

a first operating arm having a first end and a second end, the first end of the first operating arm having a first arc configuration;

a second operating arm having a first end and a second end, the first end of the second operating arm having a second arc configuration, the first operating arm and the second operating arm pivotally connecting with an axis, the second end of the first operating arm and the second end of the second operating arm being held by a user;

a ring-shaped resistance element being selectively mounted on outside of the first arc configuration and the second arc configuration; and an elongate resistance element having a first end and a second end and being selectively mounted at inside of the first arc configuration and the second arc configuration.

2. The exerciser as recited in claim 1, wherein the ring-shaped resistance element comprises a first portion and a second portion, and a side of the first portion and a side of the second portion are at least partially connected so as to prevent the first portion and the second portion from breaking at the same time.

3. The exerciser as recited in claim 1, wherein each of the first arc-shaped configuration and the second arc-shaped configuration comprises at least one limiting portion, and each of the first end and the second end of the elongate resistance element is arc-shaped so as to fit the inside of the first arc-shaped configuration of the first operating arm and the second arc-shaped configuration of the second operating arm and to position the first end and the second end of the elongate resistance element by the at least one limiting portion.

4. The exerciser as recited in claim 1, wherein the inside of each of the first arc-shaped configuration and the second arc-shaped configuration comprises a rib, and the first end and the second end of the elongate resistance element comprises a hole to be passed through by the rib.

5. The exerciser as recited in claim 1, wherein both the ring-shaped resistance element and the elongate resistance element are made of rubber.

6. The exerciser as recited in claim 1, furthering comprising a mass of an elastic substance and wherein each of a left side and a right side of the mass of the elastic substance has a recess to couple with the second end of the first operating arm and the second end of the second operating arm.

7. The exerciser as recited in claim 6, wherein the mass of the elastic substance is made of rubber or thermoplastic rubber.

* * * * *